US006162108A

United States Patent [19]

Frederiksen

[11] Patent Number: 6,162,108

[45] **Date of Patent: *Dec. 19, 2000**

[54] STACKABLE BLOCK SYSTEM

[75] Inventor: Jesper Bo Frederiksen, Nykøbing Falster, Denmark

[73] Assignee: Interlego AG, Baar, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,515

[22] PCT Filed: Sep. 28, 1995

[86] PCT No.: PCT/DK95/00388

§ 371 Date: May 19, 1997

§ 102(e) Date: May 19, 1997

[87] PCT Pub. No.: WO96/09869

PCT Pub. Date: Apr. 4, 1996

[30] Foreign Application Priority Data

Sep. 29, 1994 [DK] Denmark ..... 1120/94

[51] Int. Cl.[7] ..... A63H 33/08

[52] U.S. Cl. ..... 446/102; 446/128

[58] Field of Search ..... 446/85, 102, 104, 446/117, 118, 124, 125, 128, 116, 120; 434/219, 195, 171, 174, 403

[56] References Cited

U.S. PATENT DOCUMENTS

| | | | |
|---|---|---|---|
| 2,461,535 | 2/1949 | Erhardt | 446/104 |
| 2,649,803 | 8/1953 | Andre | 446/102 |
| 4,919,635 | 4/1990 | Bertrand | 446/124 |
| 5,554,062 | 9/1996 | Goldsen | 446/124 |
| 5,661,941 | 9/1997 | Vataker | 52/604 |

FOREIGN PATENT DOCUMENTS

| | | | |
|---|---|---|---|
| 934552 | 10/1973 | Canada | 446/118 |
| 1195407 | 11/1959 | France | 446/125 |
| 3327957 | 2/1985 | Germany | 446/120 |
| 162104 | 4/1921 | United Kingdom . | |
| 481297 | 3/1938 | United Kingdom | 446/125 |
| 958432 | 5/1964 | United Kingdom | 446/102 |
| 1225394 | 3/1971 | United Kingdom | 446/118 |
| 2118447 | 11/1983 | United Kingdom | 446/128 |

*Primary Examiner*—Jacob K. Ackun
*Assistant Examiner*—Jeffrey D. Carlson
*Attorney, Agent, or Firm*—Pitney, Hardin, Kipp & Szuch LLP

[57] ABSTRACT

A stacking block system includes a plurality of blocks, each having a top face and a plurality of side walls extending downwardly from the top face. At least one coupling knob extends upwardly from the top face and has a substantially spherical upper part and a substantially cylindrical lower part. A tubular coupler or flange extends downwardly from the top face and beyond the side walls is complementary to the coupling knob, enabling coupling of two blocks. The tubular flange guides the coupling knob to enable coupling of two blocks, even when the blocks are tilted with respect to each other.

4 Claims, 3 Drawing Sheets

STACKABLE BLOCK SYSTEM

The present invention concerns a stacking block system comprising box-shaped blocks whose upper side is provided with one or more coupling knobs arranged in a uniform pattern with a mutual firm modular distance, and whose underside is provided with complementary coupling means.

Such building block or stacking block systems are available today in numerous different embodiments, in particular with a view to the building of structures by means of the blocks. The knobs on most of the known systems are mostly plane on the surface, which impedes mounting of a block on top of another, since the two blocks are to be positioned relatively accurately with respect to each other for the coupling knobs and the complementary coupling means to engage. German Offenlegungsschrift DE 42 12 492 and EP A1 0 045 963 disclose a building block system which overcomes the above-mentioned drawback, since the blocks are upwardly provided with coupling knobs which are rounded or tapered at the surface, thereby forming a guide face which ensures easy positioning of the blocks with respect to each other when these are to be joined.

The object of the present invention is to provide a stacking block system which, to a higher degree than the known ones, provides blocks which are simple to stack, in particular for small children, i.e. children under 2–3 years of age. Another object of the present invention is to provide such a stacking block system as provides a number of different degrees of difficulty with respect to coupling or stacking blocks on top of each other.

This is achieved with a stacking block system of the type mentioned in the opening paragraph in that the coupling knobs, at least partly, form a rotationally symmetrical surface which has an upwardly rounded or tapering shape, thereby forming a guide face for the complementary coupling means, and that the greatest transverse dimension of the base face of a block having a coupling knob is smaller than or equal to the difference between the diameter and the coupling knobs and twice the modular distance.

This provides very varying degrees of difficulty for the stacking of blocks in the system. Thus, a block having just one coupling knob, when positioned on another block, will be freely rotatable on the other block, no matter how many knobs are provided on the second block, and no matter where the first block is placed on the second block. This contributes to making a stacking block having one knob extremely easy to stack on top of another block, since this just requires positioning of the block to be stacked on top of the other with respect to a coupling knob on the other block.

Thus, when a block having just one coupling knob is to be stacked, no orientation of the block is required with respect to the underlying block. However, this circumstance changes as soon as a block having two knobs is to be stacked on top of another block, since this requires a certain orientation and simultaneous positioning of the block to be stacked on top of another block. The requirement with respect to the accuracy of the orientation increases with an increasing number of knobs in a straight row on the block to be stacked on top of another block.

The stacking block system may have different patterns for the positioning of the coupling knobs, but a preferred embodiment is defined wherein the coupling knobs are arranged in a square pattern.

The guide faces on the coupling knobs may have a wide range of different embodiments, it being preferred, however, that upwardly the coupling knobs approximately form a ball face or a dome face. This results in softly rounded knobs, so that there are no sharp edges owing to the safety during play.

In one embodiment of the invention the lower part of the coupling knobs is substantially formed by a cylinder face.

In other embodiments of the present invention, the side walls of the complementary coupling means and the blocks, respectively, are formed by flanges which extend from the upper part of the block and downwardly. This provides a stacking block which can be produced in a simple manner in an injection mould, it being easy to obtain suitable slip angles and the like.

Owing to the stability, the stacking blocks may be provided with supporting ribs, which stiffen the side walls of the block and the coupling skirt with respect to each other.

The present invention is particularly contemplated for the small age groups, because the blocks are not to be assembled and separated with a frictional coupling force.

In yet another embodiment, the coupling knobs on the stacking blocks have a size with a diameter larger than 2 cm and smaller than 5 cm, thereby providing a suitable gripping face for the hands of children in the target group stated above.

The invention will be explained more fully below by means of embodiments with reference to the drawing, in which FIG. 1 is a perspective view of a stacking block having one knob according to the invention.

Figure 1:
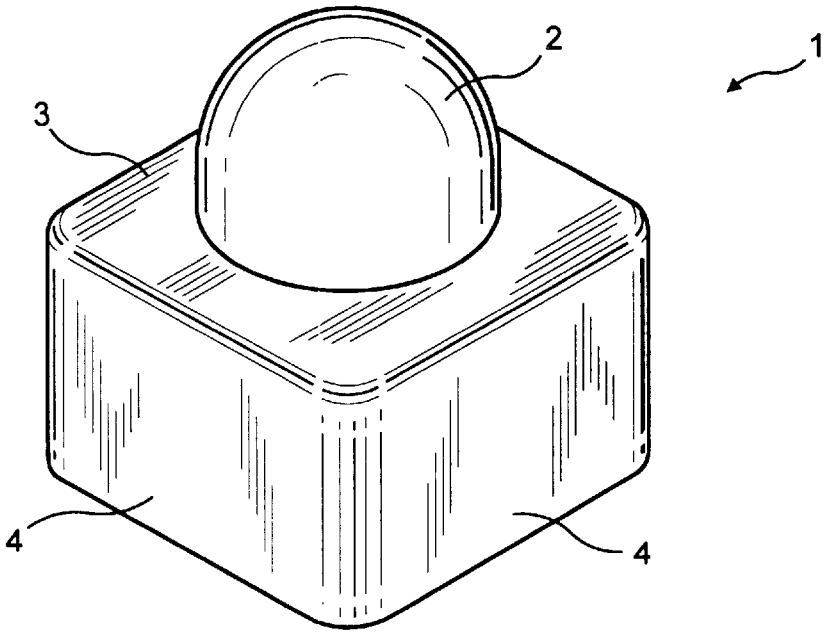

FIG. 1 thus shows a stacking block 1 having a single knob 2. The knob 2 is provided centrally on the square top face 3. The square top face 3 is defined by four side faces 4, so that the square top face 3 and the side faces 4 form a box-shaped body part on the stacking block 1. The knob 2 is downwardly shaped as a circular symmetrical cylinder, optionally with a slight cone which narrows the knob 2 upwardly. The top face of the knob 2 is here shaped as part of a ball shell, thereby imparting an appearance with very round shapes to the knob. The very round shapes on the knob 2 hereby provide a good gripping face for a child's hand, and there are no sharp edges which may be unpleasant to step on, fall on or the like.

Figure 2:
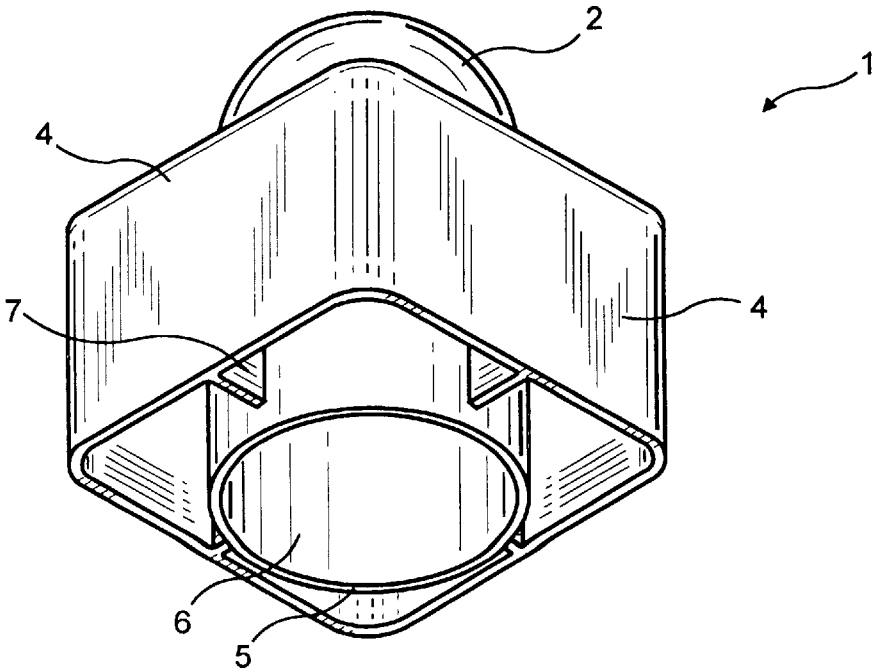
FIG. 2 is a perspective bottom view of the stacking block of FIG. 1.

FIG. 2 shows the same stacking block as is shown in FIG. 1, however seen in perspective from below to illustrate the inner shape of the stacking block. As will be seen, the stacking block 1 has an inner tubular flange 5 which extends from the square surface 3 of the stacking block 1 downwardly through the interior of the stacking block. The tubular flange 5 is open downwardly at the opening 6, and the tubular flange 5 has a diameter which is slightly larger than the diameter of the knob 2, which enables stacking of the elements on top of each other by moving the tubular flange 5 down over the knob 2, whereby two stacking blocks of the shown type are positioned with respect to each other. In this stacking process, the rounded shape of the top face of the knob 2 causes the tubular flange 5 to be guided down over the knob 2 into position, whereby two stacking blocks to be stacked are positioned in a simple manner with respect to each other. This guiding action facilitates stacking the blocks even when the blocks are tilted with respect to each other.

Further, as is shown in FIG. 2, the stacking blocks 1 may be provided with stiffening ribs 7 which stiffen the tubular flange 5 with respect to the side walls 4. This ensures that the element has a great strength with respect to the consumption of material. As shown in FIG. 2, the side walls 4, the tubular flange 5 and the stiffening ribs 7 may extend in parallel in the same direction, so that the stacking block 1 is extremely simple and inexpensive to produce in a plastics injection mould, since no core pull or the like is required.

Figure 3:
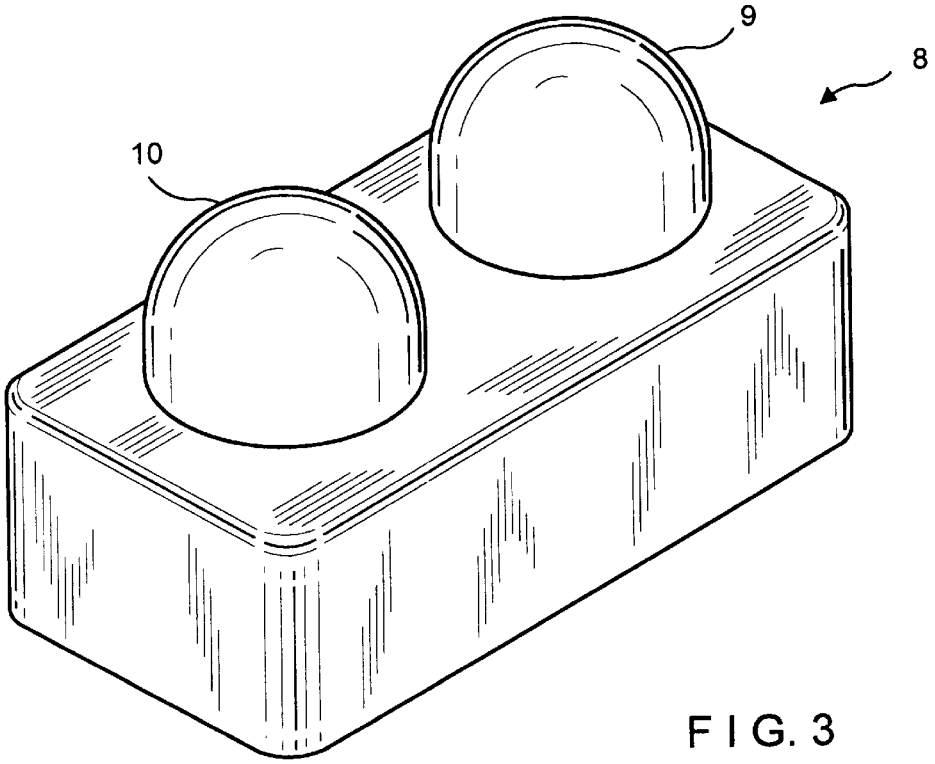
FIG. 3 is a perspective top view of a stacking block according to the invention having two knobs.

FIG. 3 shows another stacking block 8 according to the invention, which differs from the one shown in FIGS. 1 and 2 in particular in that the stacking block 8 is provided with two knobs 9 and 10, and that the stacking block 8 has approximately twice the size of the stacking block 1 according to FIGS. 1 and 2. Thus, the stacking block 8 is in reality a doubling of the stacking block 1 according to FIGS. 1 and 2, as is common in e.g. constructional building sets having building blocks. Thus, according to the invention, it is possible to produce stacking blocks having many different shapes and dimensions, in terms of width and length as well as height. Thus, a stacking block system according to the invention may comprise numerous different such embodiments.

Figure 4:
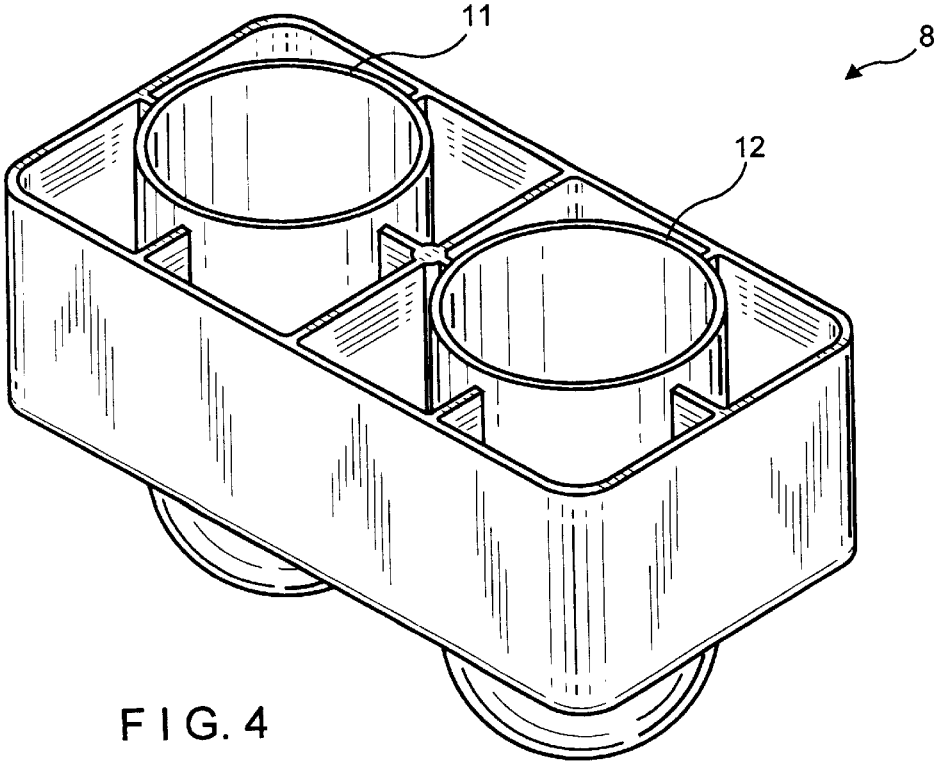
FIG. 4 is a perspective bottom view of the stacking block of FIG. 3.

FIG. 4 shows the same stacking block as FIG. 3, however seen in perspective from below, there being provided two identical tubular flanges 11 and 12 which have the same function as the tubular flange 5 in FIG. 2.

Figure 5:
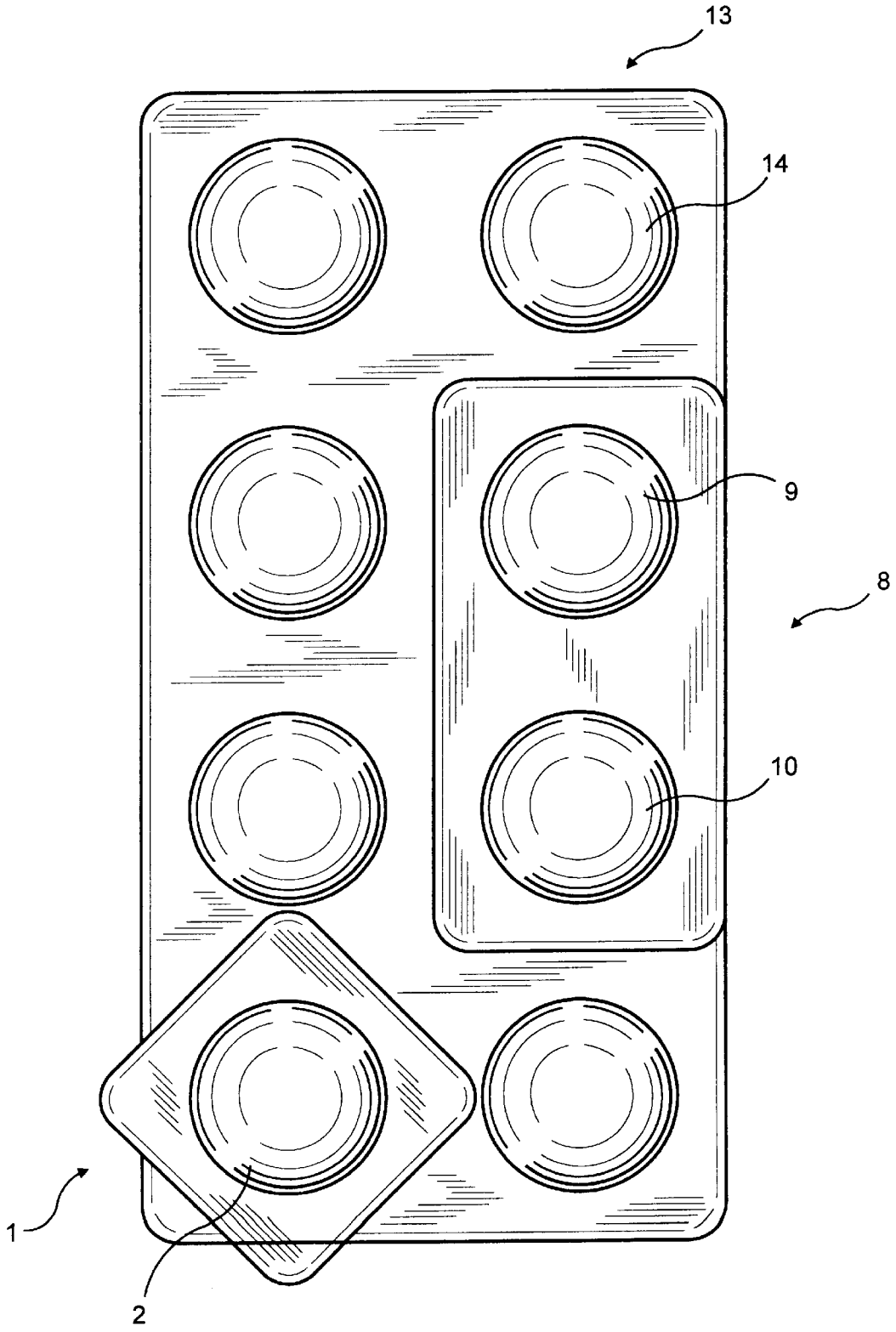
FIG. 5 shows a stacking block, seen straight from above, which has eight knobs, and on which a stacking block of FIG. 1 and a stacking block of FIG. 3 are positioned.

In FIG. 5, the advantages of the present invention are illustrated with a drawing showing a plate element 13 according to the invention which is provided with eight coupling knobs 14 arranged in a square pattern in two rows of four knobs. A stacking block 1 of FIG. 1 and a stacking block 8 of FIG. 3 are placed on top of the plate element 13. As will be seen, it is possible to place the stacking block 1 with one knob 2 on the building plate 13 in any orientation. The rounded surfaces of the knobs 14 additionally ensure that the positioning of the stacking block 1 does not have to be particularly accurate, since the stacking block is automatically guided into position and is positioned correctly in the stacking process. Thus, small children are to perform a very small effort motorically when stacking the stacking block 1 on another element according to the invention.

However, the stacking block 8 having two knobs 9 and 10, if it is to be positioned as shown in FIG. 5, require a greater accuracy in the orientation of the stacking block 8 before it is placed on top of the plate element 13. A somewhat finer motor function is required for this, so that the stacking block system of the invention provides varying degrees of difficulty for the stacking of the stacking blocks. Additionally, the requirements with respect to the motor function of the child increase, if blocks having three knobs or four, or five, etc. are stacked.

In a preferred embodiment there is no coupling force between the coupling elements, i.e. the coupling knobs and the tubular flanges of complementary shape, which in particular means that stacking blocks 1 having one knob 2 are extremely easy to rotate in their position after stacking, so that the requirements with respect to the orientation of stacking blocks 1 having one knob 2 on another element, several side by side, are relatively small, because, in most situations, a given stacking block 1 having one knob 2 will rotate into position by itself and thus assume the correct orientation, if an additional stacking block is to be placed at the side of the first one.

As will appear from the foregoing, the present invention is particularly contemplated for small children, and the preferred dimensions of the system are therefore such that the modular distance, i.e. the distance between two opposed sides 4 on the stacking block 1 having one knob 2, is in the range 3 to 7 cm, and the diameter of the knobs of the stacking blocks is in the range from 2 to 5 cm. Then, owing to their size, the coupling knobs provide an extremely good gripping face for a child's hand, so that it is easy to lift a stacking block by gripping the coupling knob, although the stacking block is surrounded at the sides by other stacking blocks or the like.

It is clear that numerous different embodiments of stacking block systems according to the invention may be provided, without departing from the idea of the invention. Thus, the coupling knobs may be shaped in many different ways, thereby also providing guide faces on the surface of the coupling knobs which facilitats coupling of the blocks. In addition, the coupling knobs and the tubular flanges of complementary shape may be arranged in a pattern other than the shown one, such as a triangular pattern, without departing from the basic idea of the invention.

What is claimed is:

1. A stacking block system comprising:

a plurality of blocks, each of said blocks having a top face and a plurality of side walls extending downwardly therefrom, said blocks including a single-knobbed block having a single coupling knob extending upwardly from said top face, said blocks including a multiple-knobbed block having a plurality of coupling knobs extending upwardly from said top face; each coupling knob having a upper part substantially spherical in shape and a lower part substantially cylindrical in shape; and said single-knobbed blocks each having at least one complementary tubular coupling means for coupling with a coupling knob on another block, said at least one complementary tubular coupling means extending downwardly from said top face and extending beyond said side walls;

and wherein said coupling knobs and said blocks are dimensioned and arranged such that when a single-knobbed block is coupled with a coupling knob on a multiple-knobbed block said single-knobbed block is free to rotate fully about an axis through said coupling knob;

and wherein said coupling knobs are arranged in a uniform pattern on multiple-knobbed blocks.

2. A stacking block system according to claim 1, wherein the distance between adjacent coupling knobs on a multiple-knobbed block is a constant.

3. A stacking block system according to claim 1, wherein stiffening ribs (7) are provided between said side walls and said complementary tubular coupling means.

4. A stacking block system according to claim 1, wherein said coupling knobs (2, 9, 10, 14) have a diameter which is larger than 2 cm and smaller than 5 cm.

* * * * *